US005620315A

United States Patent [19]

Pfuhler

[11] Patent Number: 5,620,315

[45] Date of Patent: Apr. 15, 1997

[54] GEAR PUMP FOR FEEDING OF FLUIDS

[75] Inventor: Ulrich Pfuhler, Ulm, Germany

[73] Assignee: Sandra Hutter, Neresheim, Germany; a part interest

[21] Appl. No.: 530,218

[22] PCT Filed: Mar. 26, 1994

[86] PCT No.: PCT/EP94/00961

§ 371 Date: Sep. 29, 1995

§ 102(e) Date: Sep. 29, 1995

[87] PCT Pub. No.: WO94/23209

PCT Pub. Date: Oct. 13, 1994

[30] Foreign Application Priority Data

Mar. 31, 1993 [DE] Germany ..... 43 10 518.1

[51] Int. Cl.[6] ..... F01C 21/16

[52] U.S. Cl. ..... 418/21

[58] Field of Search ..... 418/9, 10, 19, 418/20, 21

[56] References Cited

U.S. PATENT DOCUMENTS 2,633,806 4/1953 Perkins ..... 103/120

3,588,295 6/1971 Burk ..... 418/21

5,184,947 2/1993 Coombe ..... 418/20

FOREIGN PATENT DOCUMENTS 1125992 5/1955 France .

4121074A1 1/1993 Germany .

*Primary Examiner*—Charles G. Freay

*Attorney, Agent, or Firm*—Baker & Daniels

[57] ABSTRACT

Gear pump or motor to deliver fluid medium or use fluid medium as power source, respectively. The pump or motor has at least two gears contained within a housing. At least one gear is in a fixed position while the other gear is in slidable engagement with the fixed gear. In the pump configuration, fluid is introduced into the housing on one side of the engaged gears and is drawn through decreasingly wide passages by the rotating gears. The fluid thereby passes to the other side of the gears and exits the pump at a greater pressure. A control medium is used to control the position of the slidable gear. The greater the overlap between the gears the greater the volume of pumped fluid.

5 Claims, 8 Drawing Sheets

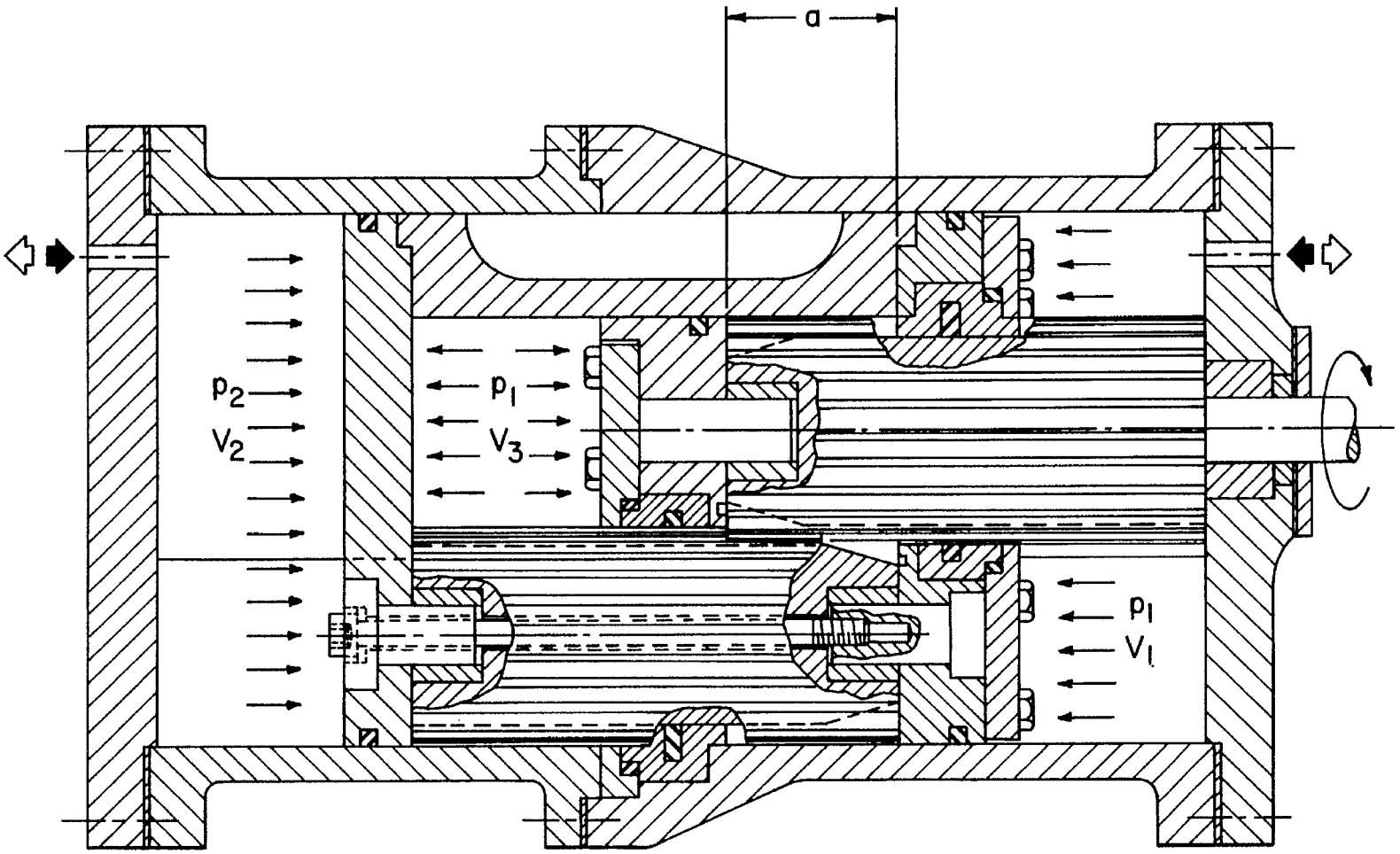
FIG. 7.1

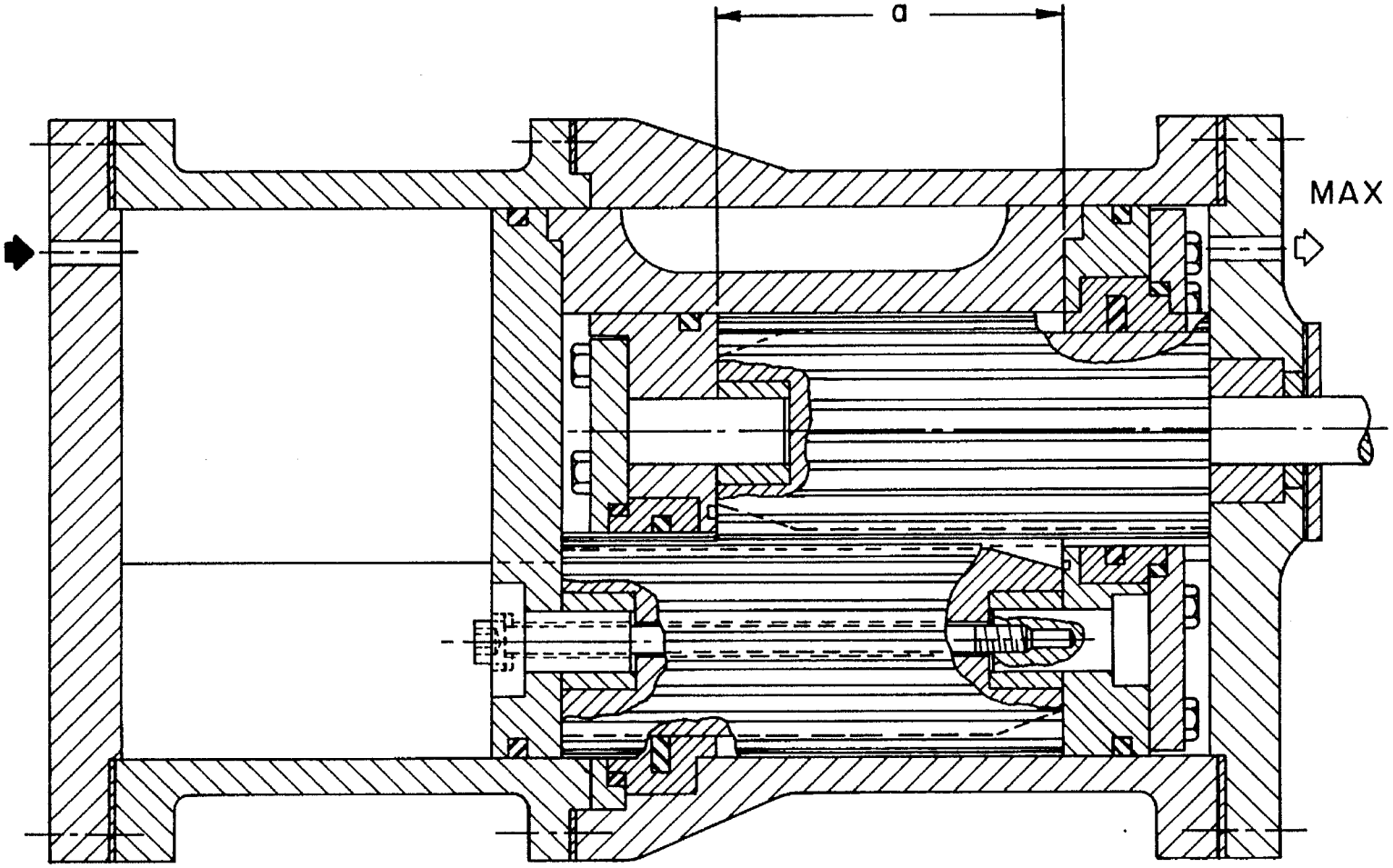
FIG. 7.2

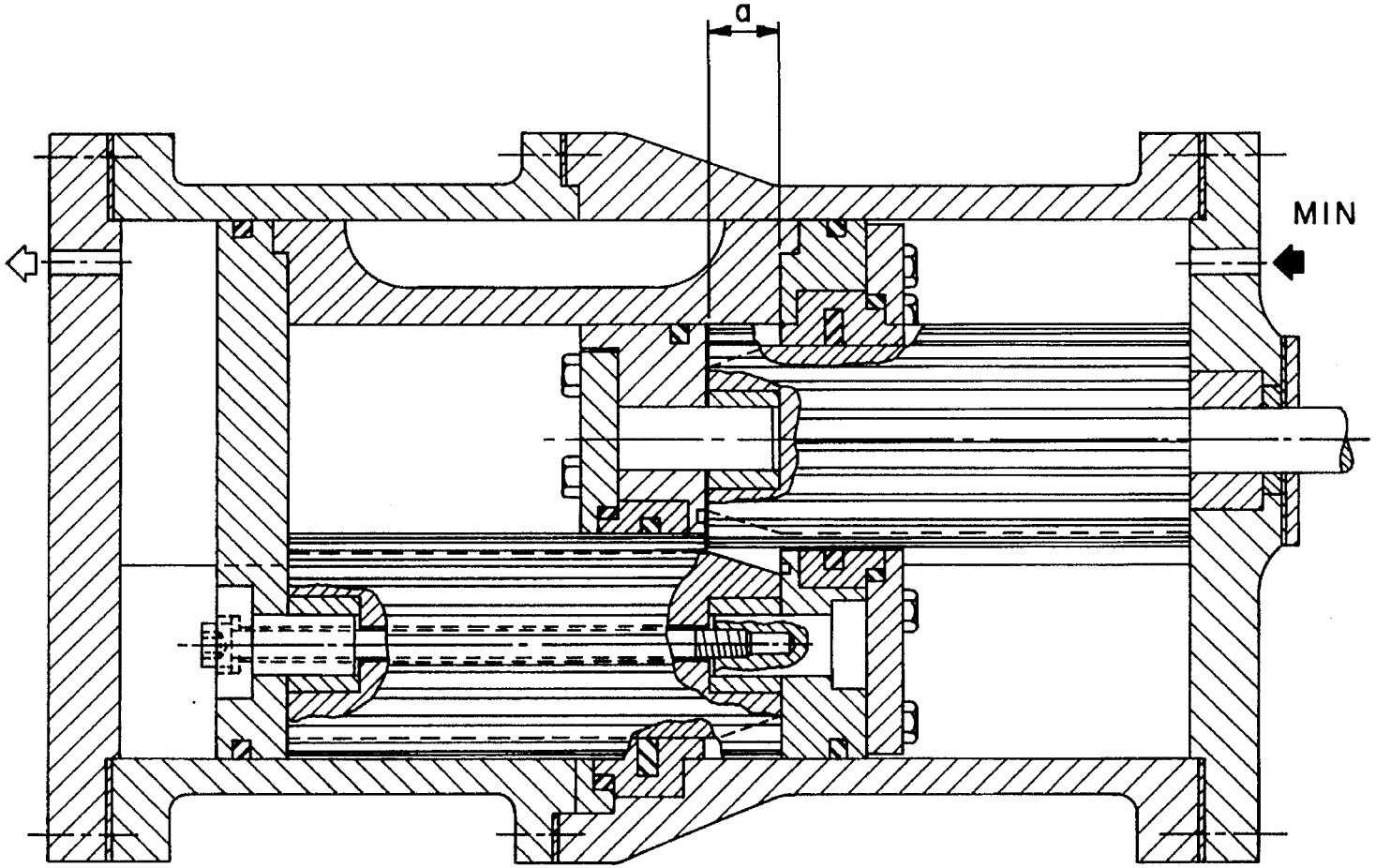
FIG. 7.3

GEAR PUMP FOR FEEDING OF FLUIDS

BACKGROUND OF THE INVENTION

The invention relates to a gear pump for feeding of fluids, in which the pump includes gears arranged axially parallel to each other and meshing in pairs within a housing having a peripheral wall. One gear is axially fixed to the housing while the other is movable in the axial direction.

Gear pumps of this type are employed for stationary as well as for mobil applications. The known advantages mainly consist in the fact that high and super high pressures may be achieved, thereby allowing for relatively exact volumetric metering.

It has become known in the relevant art to shift gears which are meshing with each other, in an axial direction relative to each other, in order to change the amount of pumped fluid during operation. This concept is disclosed in U.S. Pat. No. 5,184,947 wherein a gear which is axially non-shiftable is journalled in a housing. A second gear which meshes with the first gear, is supported by a slide block, which is shiftable relative to the axis of the first gear.

German Patent No. OS-41 21 074 A1 describes an external gear pump for a continuously variable flow of fluid. This patent discloses two gears which are shiftable relative to each other. The driven gear is journalled in a housing, whereas the idle gear may be shifted depending on the pressure differential of the fluid at the pump.

It is the disadvantage of all these known devices that the sealing of the pumping chamber is not satisfactory. The sealing devices are subject to very substantial pressures and therefore to a high wear which limits the lifetime of the gear pump.

SUMMARY OF THE INVENTION

It is the object of the invention to provide a gear pump according to the above description which meets the main requirement of an easy and rapid change of the volume of pumped fluid during operation, while at the same time, subjecting the sealing devices to much less wear compared to known gear pumps, and thereby keeping the costs of manufacture relatively low.

The present invention, in one form, is a fluid gear pump or motor. The fluid gear pump or motor comprises a casing having a peripheral wall with the peripheral wall having an inner surface. A pair of gears, a fixed gear and a movable gear, are mounted inside of the casing. The fixed gear has two ends, a fixed end and a free end, with the fixed end being rotatably mounted in the casing. The movable gear, which has a first and second end, is axially parallel to, and meshes with the fixed gear.

Also within the casing are first and second end walls which rotatably receive the first and second ends of the movable gear. These two end walls are in slidable sealing contact with the interior surface of the peripheral wall of the casing. Aside from the movable gear, the two end walls are also bridged by a wall, which has an interior wall surface. The first and second walls and the bridging wall together form a carriage which is slidable within the casing. The interior wall surface together with the axially fixed gear and the axially movable gear form a first delivery gap and a second delivery gap which extend across part of the circumference of the axially fixed gear and the axially movable gear. Each delivery gap has an entry area provided with a low-pressure space having an inlet and an outlet area provided with a high pressure space having an outlet.

A third end wall, also within the casing rotatably receives the free end of the fixed gear. This third end wall bears under seal on the interior wall surface of the bridging wall.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIGS. 7.1, 7.2 and 7.3 depict the pump at three different phases of operation.

DETAILED DESCRIPTION OF THE INVENTION

Figure 1:
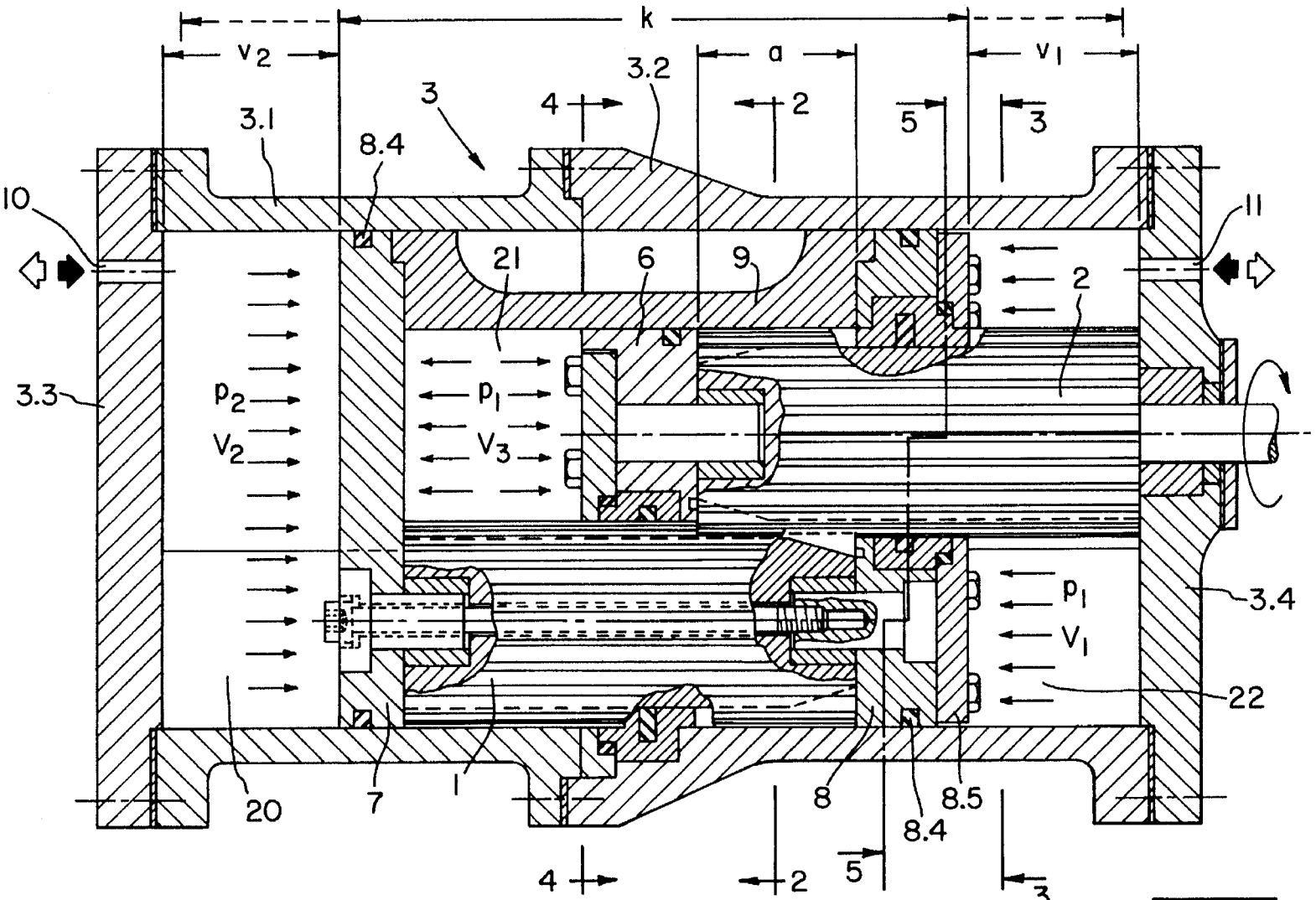
FIG. 1 depicts a longitudinal sectional view of a gear pump comprising two gears.

The gear pump according to FIGS. 1–6 comprises two gears 1 and 2. These are arranged with their axis parallel to each other and meshing with each other on a portion of their length. There is provided a housing 3, comprising peripheral walls 3.1 and 3.2 as well as end walls 3.3 and 3.4. One of the two gears, gear 2, is axially non-shiftable. At the right-hand end thereof it is journalled in end wall 3.4, and at its left-hand end it is journalled in an intermediate wall 6. The intermediate wall 6 and the peripheral wall 3.2 of the housing form one single part, which in the present case is made of cast iron. The other one of the two gears, gear 1, is shiftable in the axial direction, and accordingly relative to gear 2 and to housing 3. It is journalled in end walls 7, 8, which are both shiftable with gear 1. Additionally, the shiftable walls 7, 8 are fixedly connected with each other by a bridge 9. The shiftable walls 7, 8, as well as bridge 9, form an axially shiftable slide. Two chambers, one between the left-sided end wall 3.3 of the housing and the shiftable end wall 7, and the other between the right-sided end wall 3.4 of the housing and the shiftable end wall 8, are provided with inlets 10, 11 for the entrance, respectively, or exit of a control medium.

Figure 2:
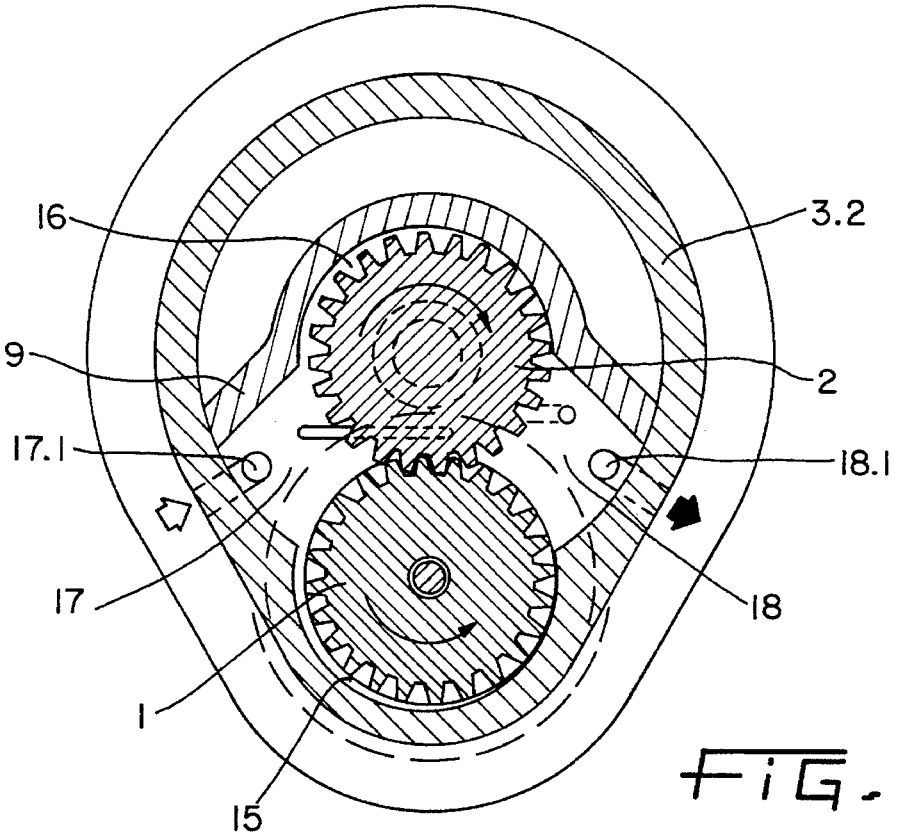
FIGS. 2–5 are cross-sectional views in the planes A—A, B—B, C—C and in the offset plane D—D.
Figure 3:
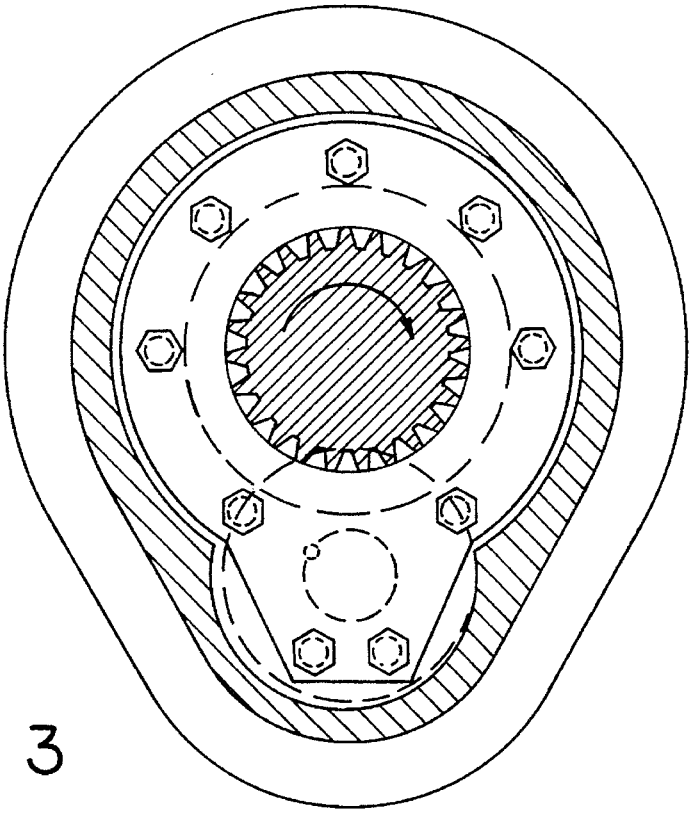
Figure 4:
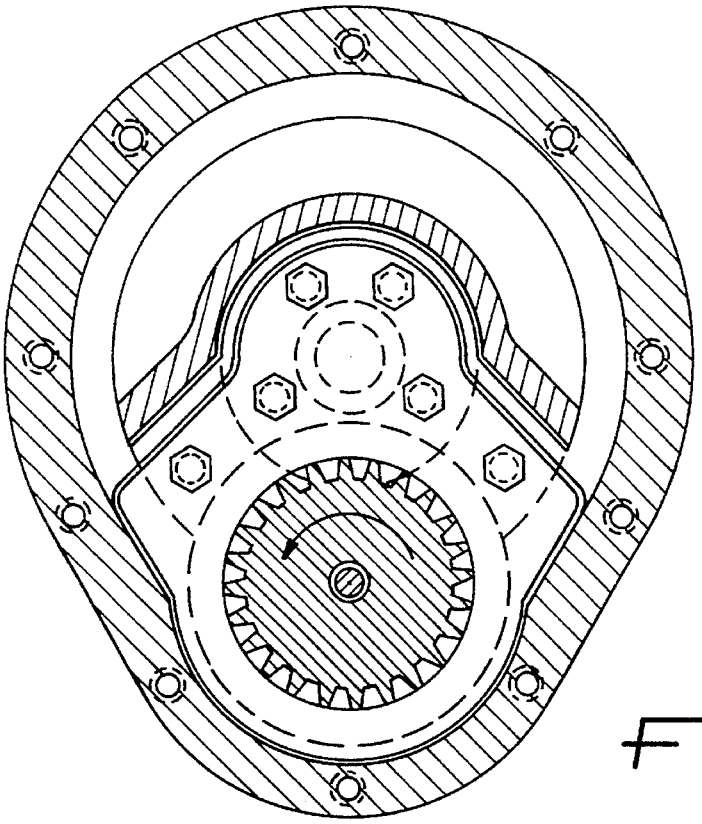
Figure 5:
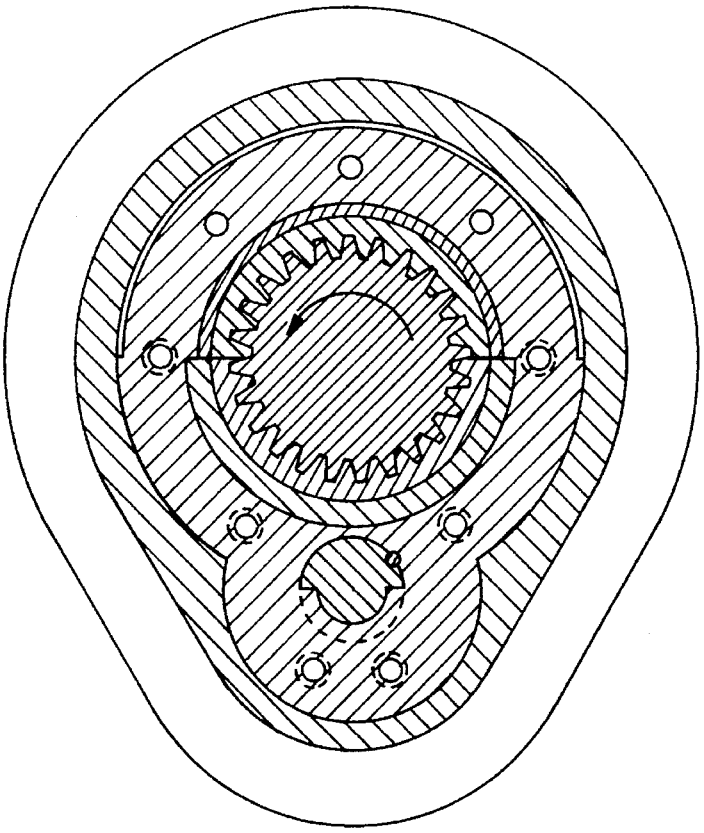

From FIG. 2 it may be seen that the two gears 1, 2 mesh with each other. Furthermore, they are, in a very distinct way, embraced by the peripheral wall 3.2 of the housing, on the one hand, and by the bridge 9, on the other hand. As may be seen from FIG. 2, the inner surface of the peripheral wall 3.2 forms, together with gear 1 along a portion of the circumference thereof, a feeding gap 15. The inner surface of bridge 9, to the contrary, forms with gear 2, along a portion of the circumference thereof, a feeding gap 16. As may be seen, the widths of the feeding gaps 15, 16 decrease in the direction of rotation of the gears 1, 2. An inlet area 17 for the fluid to be pumped includes an inlet 17.1, and an outlet area 18 includes an outlet 18.1. As may further be seen from FIG. 1, the inlet and outlet areas 17, 18 in connection with the inner surfaces of the peripheral wall 3.2 of the housing and of the bridge 9 as well as of the circumferences of the two gears 1 and 2 are limited. As may be seen from FIG. 1, the right-hand surface of the intermediate wall 6 and the left-hand surface of the shiftable end wall 8 serve to limit the amount of axial movement allowed by movable gear 1. These two last named surfaces at the same time define the pumping chamber of the gear pump.

Figure 6:
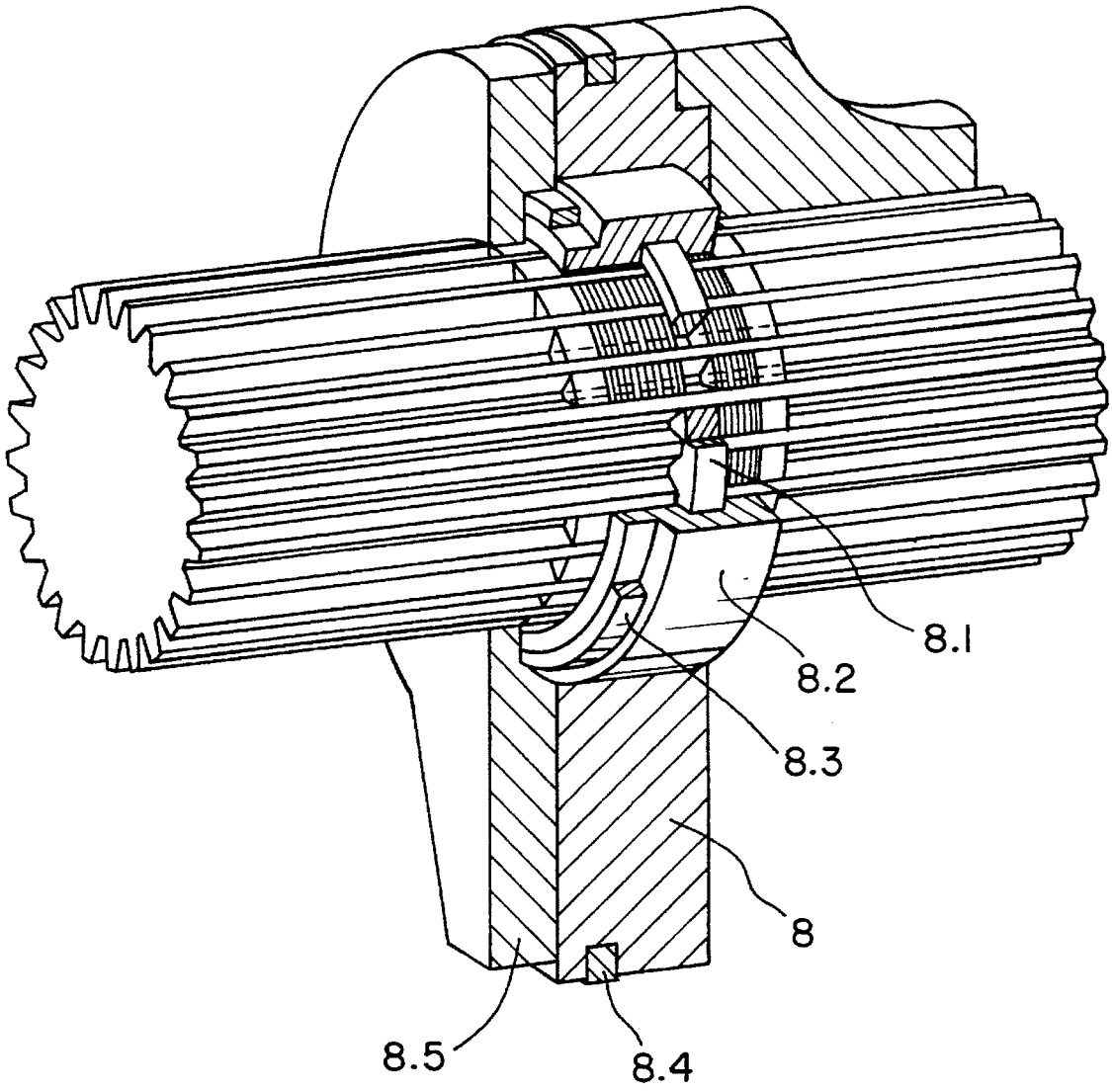
FIG. 6 depicts an enlarged perspective view of the non-shiftable gear, comprising details of a shiftable end wall as well as the corresponding sealing devices.

FIG. 6 shows that the shiftable intermediate wall 8 not only serves to confine and seal the pumping chamber, but also provides a bearing for gear 2. More in detail, FIG. 6 shows wall 8, a radial bearing 8.1 supported by the same wall, a seal 8.2 for sealing of the contour of the teeth against the radial bearing 8.1, a shaft seal 8.3 as well as a seal 8.4 for sealing of the shiftable wall 8 against the peripheral wall 3.2 of the housing 3. Also, a portion of bridge 9 as well as a cover 8.5 of the slide may be seen.

Housing 3 comprises three chambers 20, 21, 22. One of these chambers, chamber 21, is located next to bridge 9. It is advantageous to have chambers 21 and 22 under pressure. Thereby, walls 6 and 8 and the surrounding seals 8.2, 8.3 and 8.4 are subjected to pressure from the outside, which relieves all seals between the fixed and the movable parts.

It is advantageous to provide a fluid connection between chambers 21 and 22, such that one of these chambers may feed the other one.

The method of operation of this first embodiment of a gear pump according to the invention is shown in FIG. 7, whereby the various working positions are shown in FIGS. 7.1, 7.2 and 7.3.

According to the embodiment of FIG. 7.1, the slide including gear 1 has been moved into an intermediate position, whereby the axial degree of overlapping of the two gears 1, 2 assumes an intermediate value. In this state, the pump volume has a medium value.

With the working position shown in FIG. 7.2, the degree of overlapping of the two gears 1, 2 is as great as is possible with regard to the design of the pump. The slide and gear 1 are both are shifted as far as possible to the right. The degree of overlapping is at a maximum value and accordingly, the pumped volume is at its maximum value.

In the working position, according to FIG. 7.3, the degree of overlapping is at about zero, and accordingly so is the pumped volume.

The control of the slide will be made through the above mentioned connections 10 and 11 by means of a suitable pressurized control medium. The slide is able to shift continuously, and may be maintained in any desired position. It will be seen that a continuous adjustment of the pumped amount is possible during operation.

The pump may be adjusted by hydrostatic pressure, either generated externally, or by its own, in the latter case only during operation. In order to have the adjustment pressure available at any time, a pressure reservoir could be provided. Such a reservoir only needs minimum dimensions and may by located between the peripheral walls 3.1, 3.2 on the one hand, and bridge 9 on the other hand, if desired.

Figure 8:
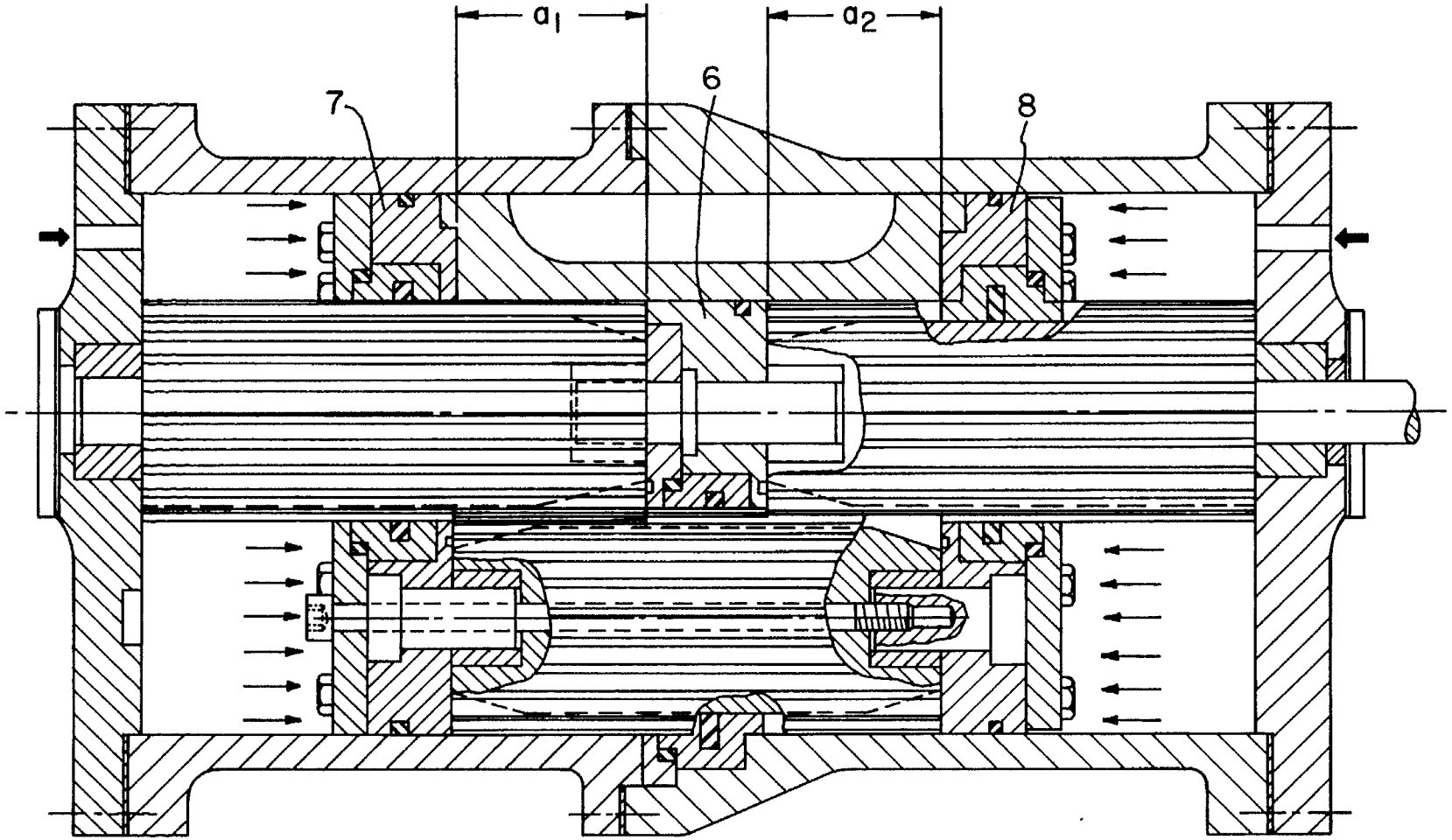
FIG. 8 depicts a further embodiment of a gear pump according to the invention, comprising two gears which are axially fixed relative to each other as well as a gear which is shiftable relative to the said first two gears.

The second embodiment of a gear pump according to the invention, shown in FIG. 8, is different from the first embodiment in that there are provided three gears, including a lower, axially shiftable gear 1 as well as two upper, axially fixed gears 2.1, 2.2, which are arranged co-axially relative to each other. Here again, a housing 3 is shown comprising peripheral walls 3.1, 3.2, end walls 3.3 and 3.4 as well as all essential further components of the first embodiment.

It is an advantage of the three-gear-embodiment that it comprises two working chambers. The width of the working chambers is indicated by reference numeral $a_1$ and $a_2$. The working chambers are confined by outer shiftable end walls 7, 8 of the slide as well as by a fixed intermediate wall 6.

As may best be seen from the longitudinal sections, the bottom of the tooth gap of each tooth at the end of the working chamber is somewhat lowered radially and inwardly, such that it decreases against the end surface of the respective tooth. This allows for the proper removal of excess oil into low-pressure area 17.

It should be clear that the term "gear" should not be interpreted too narrowly. The drawings, for example, show gears of substantial axial extension, whereby the ratio between the axial length and the diameter is relatively great, such as 2:1. Instead, the invention may also be applied with gears which have a relatively small axial dimension, and therefore a relatively low ratio between the axial dimension and their diameters.

In addition, it should be clear that the invention is not applicable to pumps only, but also to hydrostatic motors.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

I claim:

1. A fluid gear pump or motor comprising:

an axially fixed gear having a free end and a fixed end;

an axially movable gear axially parallel to, and meshing with, said axially fixed gear, said axially movable gear having first and second ends, said second end proximate said fixed end of said axially fixed gear;

a casing enclosing said axially fixed gear and said axially movable gear, said casing having a peripheral wall, said peripheral wall having an interior surface, said axially fixed gear axially fixed to said casing;

a first end wall and a second end wall in sealing contact with said interior surface of said peripheral wall of said casing, said first end of said axially movable gear rotatably mounted in said first end wall, said second end of said axially movable gear rotatably mounted in said second end wall;

a wall bridging said first end wall and said second end wall, said bridging wall having an interior wall surface and forming with said first end wall and said second end wall a carriage axially movable within said casing, said interior wall surface of said bridging wall forming with said axially fixed gear a first delivery gap extending across part of the circumference of said axially fixed gear, said interior surface of said peripheral wall and said axially movable gear forming a second delivery gap extending across part of the circumference of said axially movable gear, said delivery gaps each having an entry area provided with a low pressure space having an inlet, and an outlet area provided with a high pressure space having an outlet; and a third end wall sealingly contacting said interior wall surface of said bridging wall, said free end of said axially fixed gear rotatably attached to said third end wall.

2. A gear pump or motor as set forth in claim 1 further comprising a first end space between said casing and said first end wall and a second end space between said second end wall and said casing wherein said first end space and said second end space are connected to a pressure medium.

3. A fluid gear pump or motor as recited in claim 1 further comprising tooth spaced bottoms on said second end of said axially movable gear and said free end of said axially fixed gear, said tooth spaced bottoms recessed radially inward for removal of excess oil to said low-pressure spaces.

4. A gear pump or motor as set forth in claim 1 further comprising a second axially fixed gear coaxial to said axially fixed gear.

5. A fluid gear pump or motor as recited in claim 1 further comprising an internal bearing wherein said movable gear is installed using said internal bearing, said internal bearing having a journal and a bushing coaxial to said internal bearing and an aperture for accommodating said journal and bushing, said journal and said bushing assigned to said axially movable gear, said aperture assigned to said second end wall.

* * * * *